US007965164B2

(12) United States Patent
Park et al.

(10) Patent No.: US 7,965,164 B2
(45) Date of Patent: Jun. 21, 2011

(54) MULTI-OUTPUT TRANSFORMER

(75) Inventors: Jeong Hyun Park, Jeollabuk-do (KR); Jong Rak Kim, Suwon-si (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 5 days.

(21) Appl. No.: 12/137,438

(22) Filed: Jun. 11, 2008

(65) Prior Publication Data

US 2009/0243776 A1 Oct. 1, 2009

(30) Foreign Application Priority Data

Mar. 31, 2008 (KR) ..... 10-2008-0029652
Mar. 31, 2008 (KR) ..... 10-2008-0029656

(51) Int. Cl.
*H01F 27/28* (2006.01)
*H01F 27/30* (2006.01)

(52) U.S. Cl. ..... 336/182; 336/183; 336/196

(58) Field of Classification Search ..... 336/18–183, 336/196

See application file for complete search history.

(56) References Cited

U.S. PATENT DOCUMENTS 6,771,157 B2 * 8/2004 Nishikawa et al. ..... 336/178
7,015,784 B2 * 3/2006 Kohno ..... 336/170
7,274,282 B2 * 9/2007 Park et al. ..... 336/192

FOREIGN PATENT DOCUMENTS

JP 2000-012350 A 1/2000
KR 10-2005-0027659 A 3/2005
KR 10-2006-0134639 A 12/2006

* cited by examiner

*Primary Examiner* — Anh T Mai
*Assistant Examiner* — Ronald W Hinson
(74) *Attorney, Agent, or Firm* — Lowe, Hauptman, Ham & Berner, LLP

(57) ABSTRACT

In accordance with the present invention, a multi-output transformer includes a primary bobbin provided with one primary winding unit with one input terminal and one ground terminal; a secondary bobbin provided with n(n: positive integer) number of secondary winding units with two output terminals respectively; a primary coil wound around the one primary winding unit; secondary coils wound around each of the n secondary winding units; and a pair of cores inserted into insertion holes formed inside the primary bobbin and the secondary bobbin respectively to separate the primary bobbin and the secondary bobbin.

1 Claim, 8 Drawing Sheets

[FIG. 1]
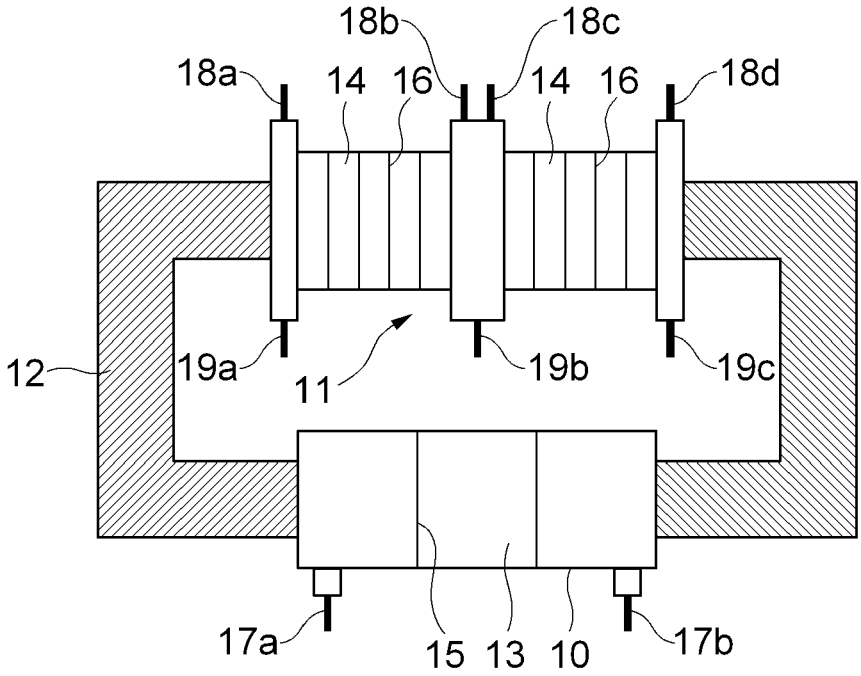
[FIG. 2]
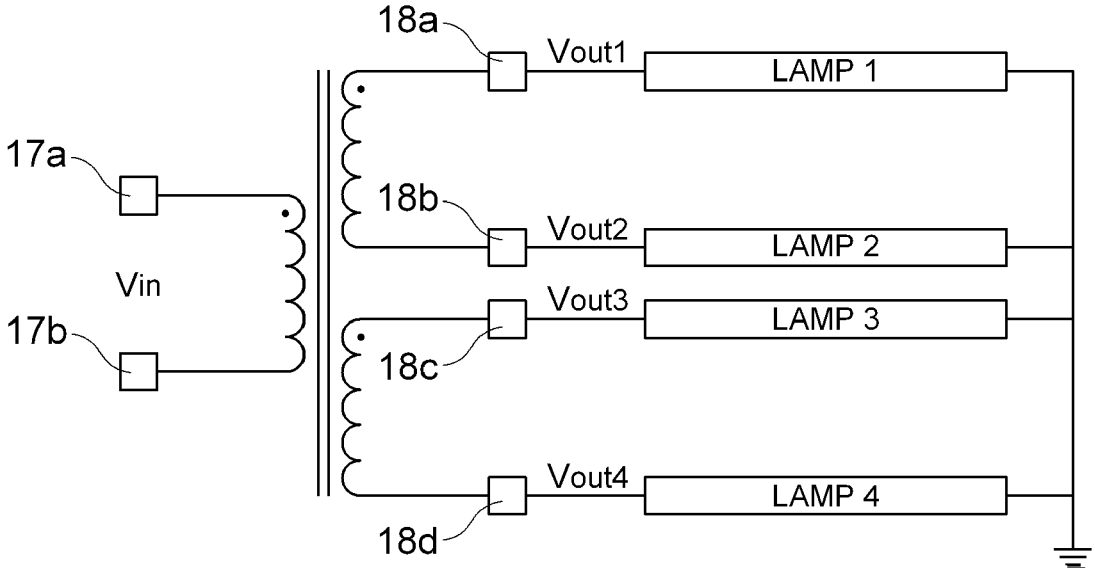

[FIG. 3]
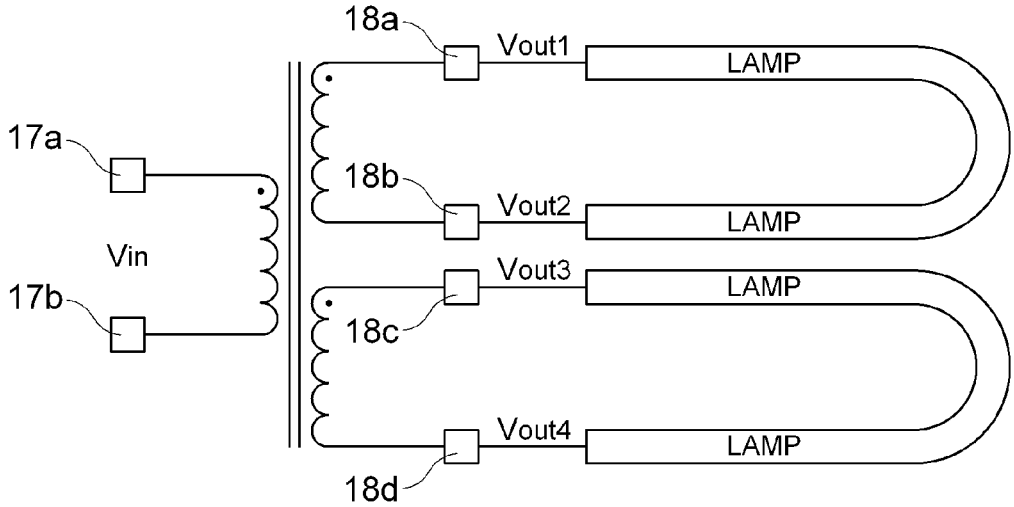
[FIG. 4]
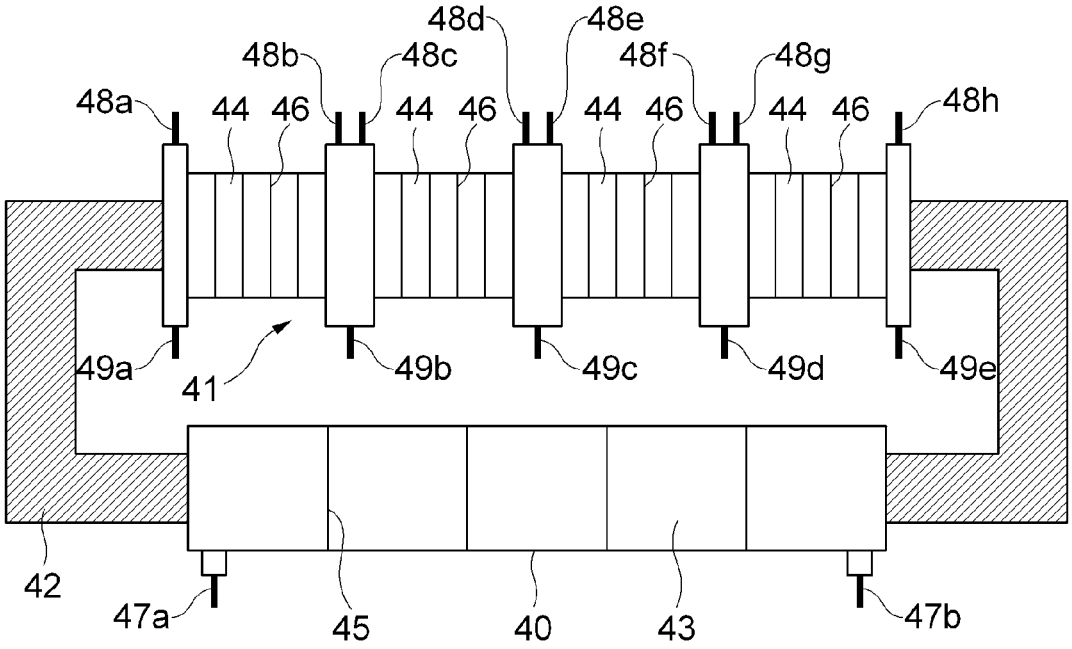

[FIG. 5]
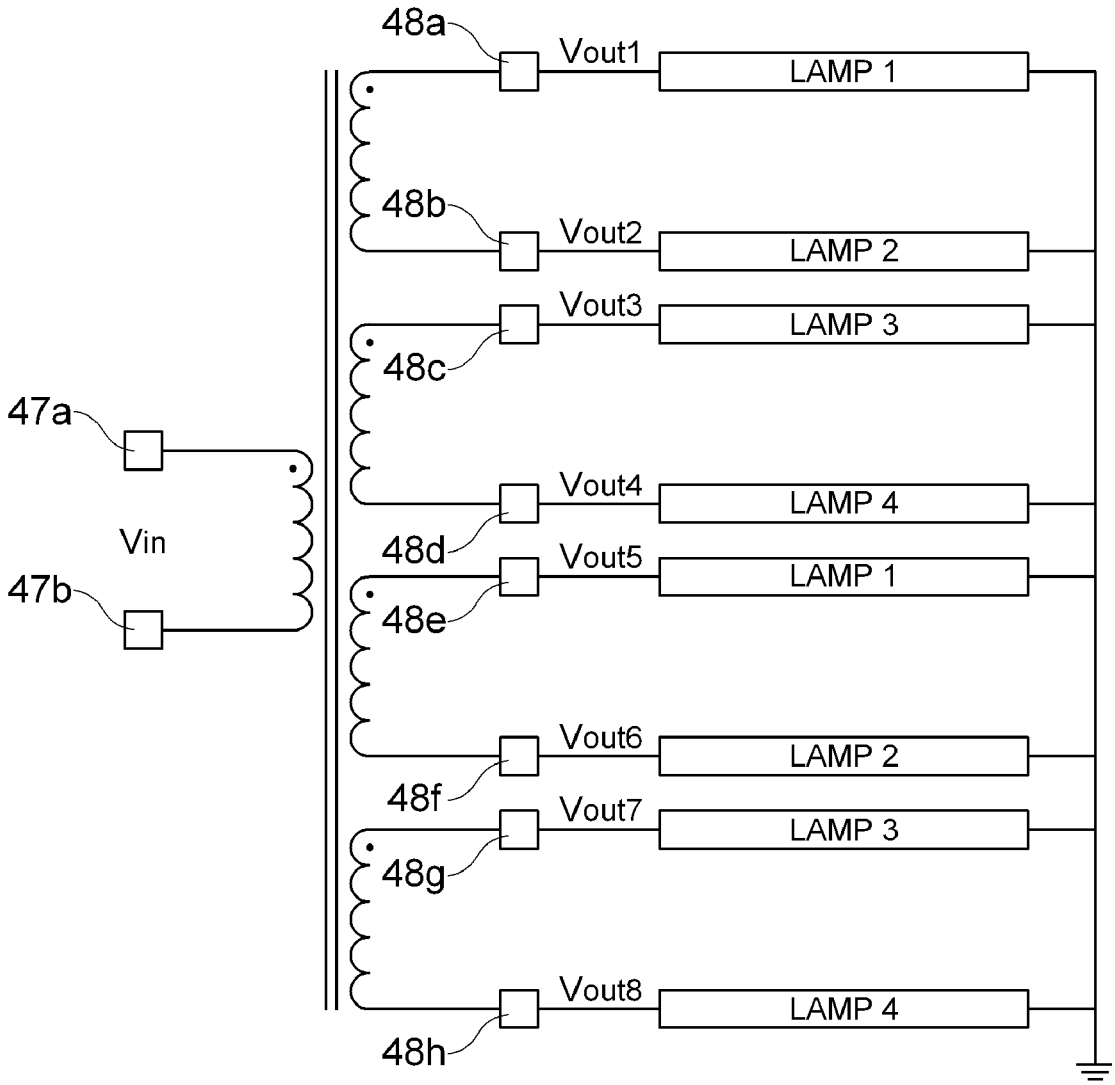

[FIG. 6]
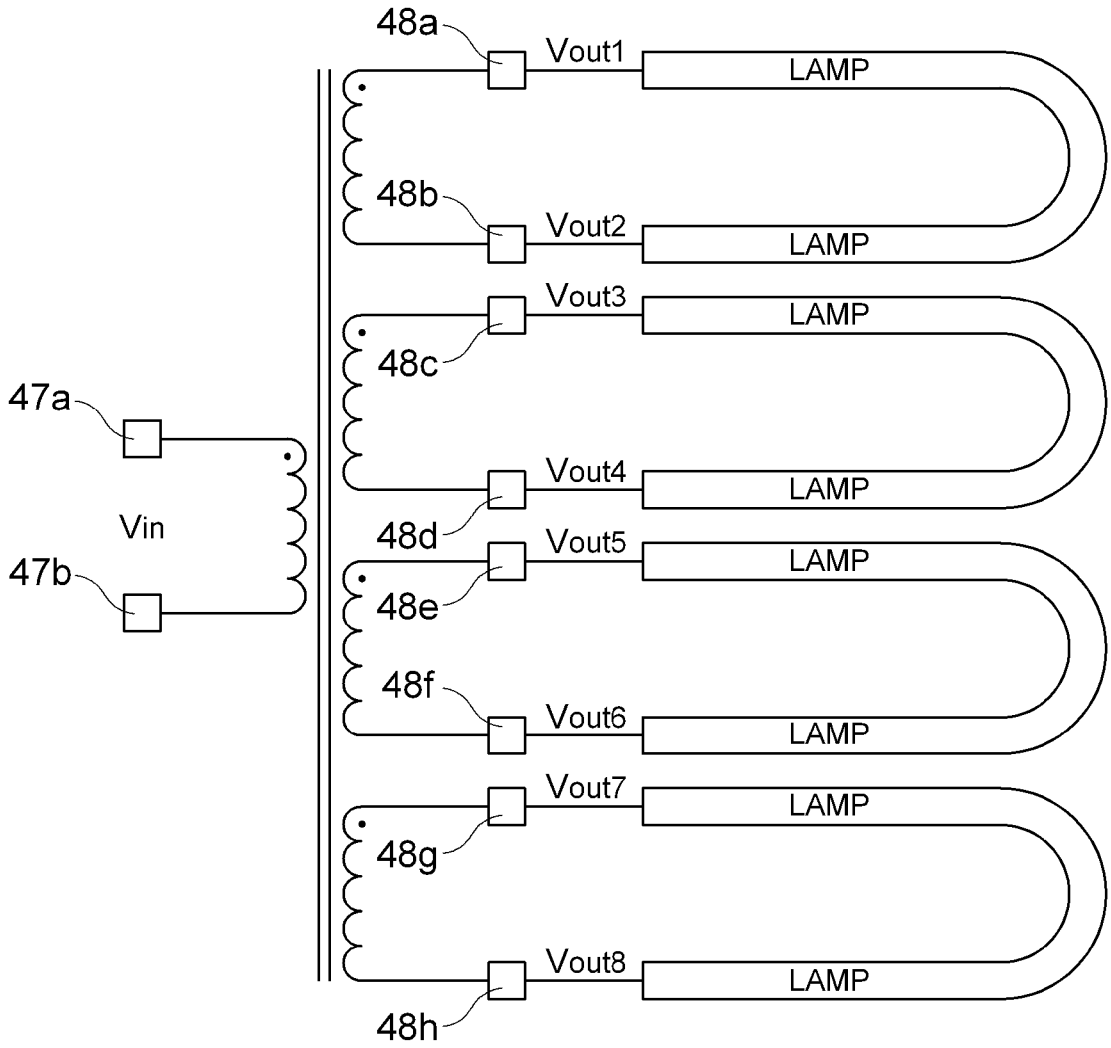

[FIG. 7]
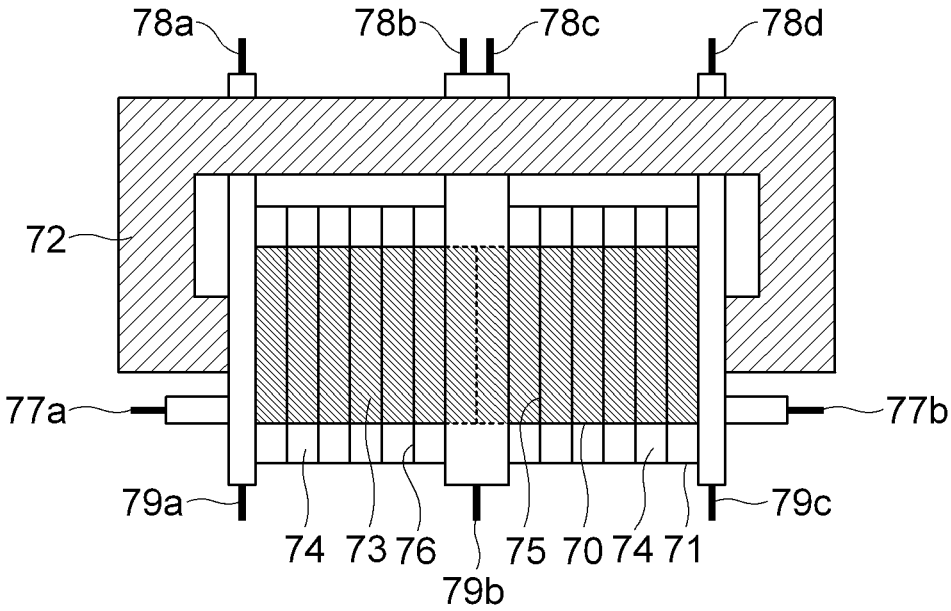
[FIG. 8]
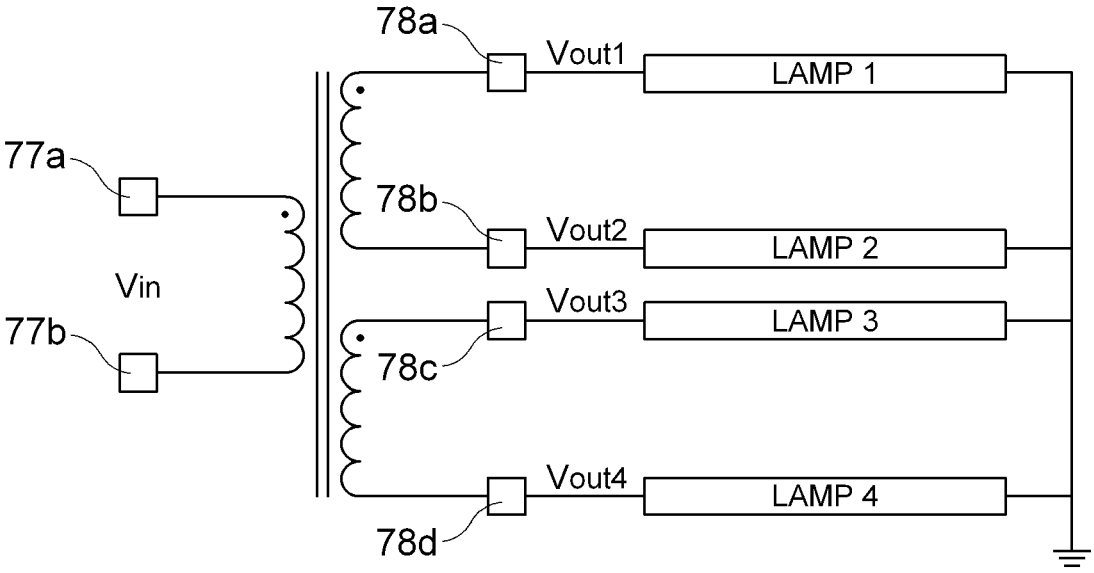

[FIG. 9]
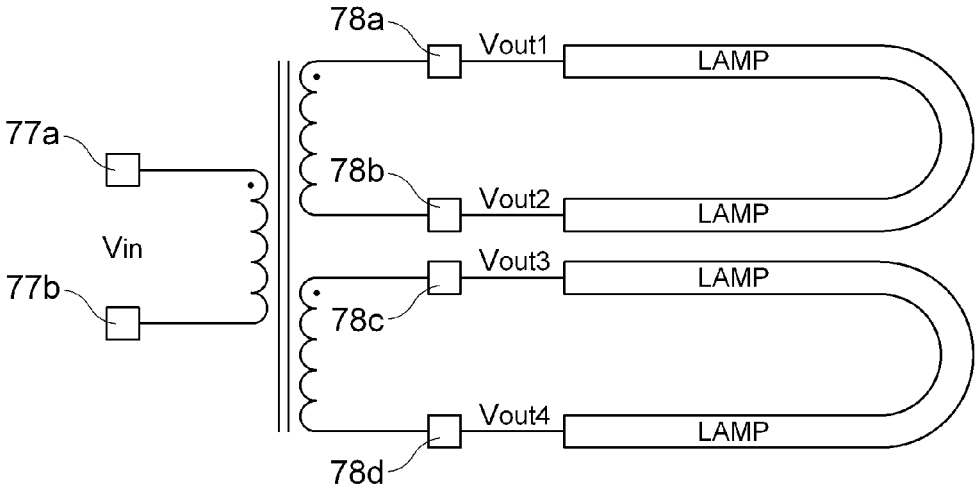
[FIG. 10]
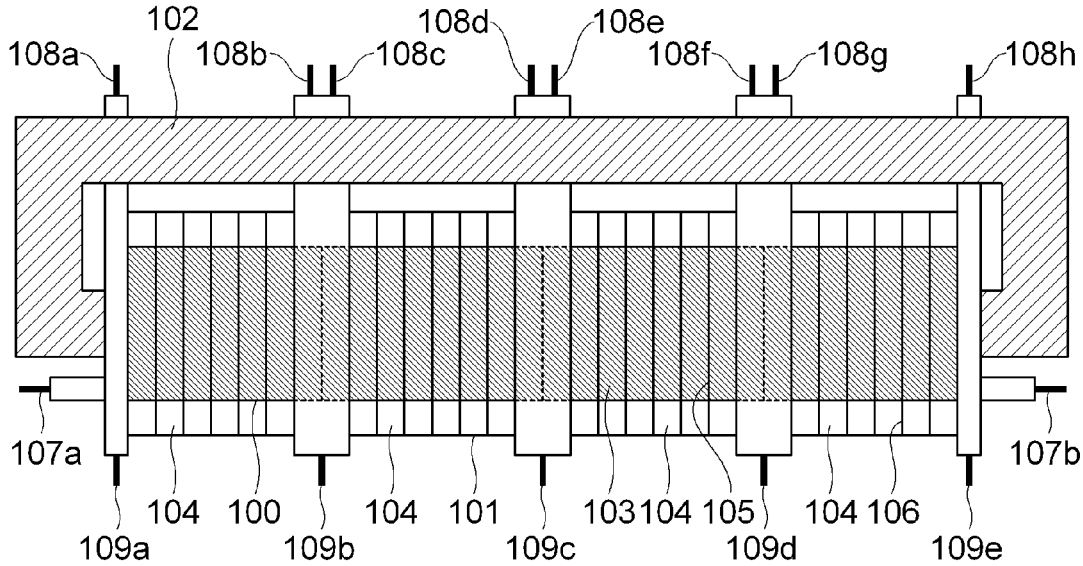

[FIG. 11]
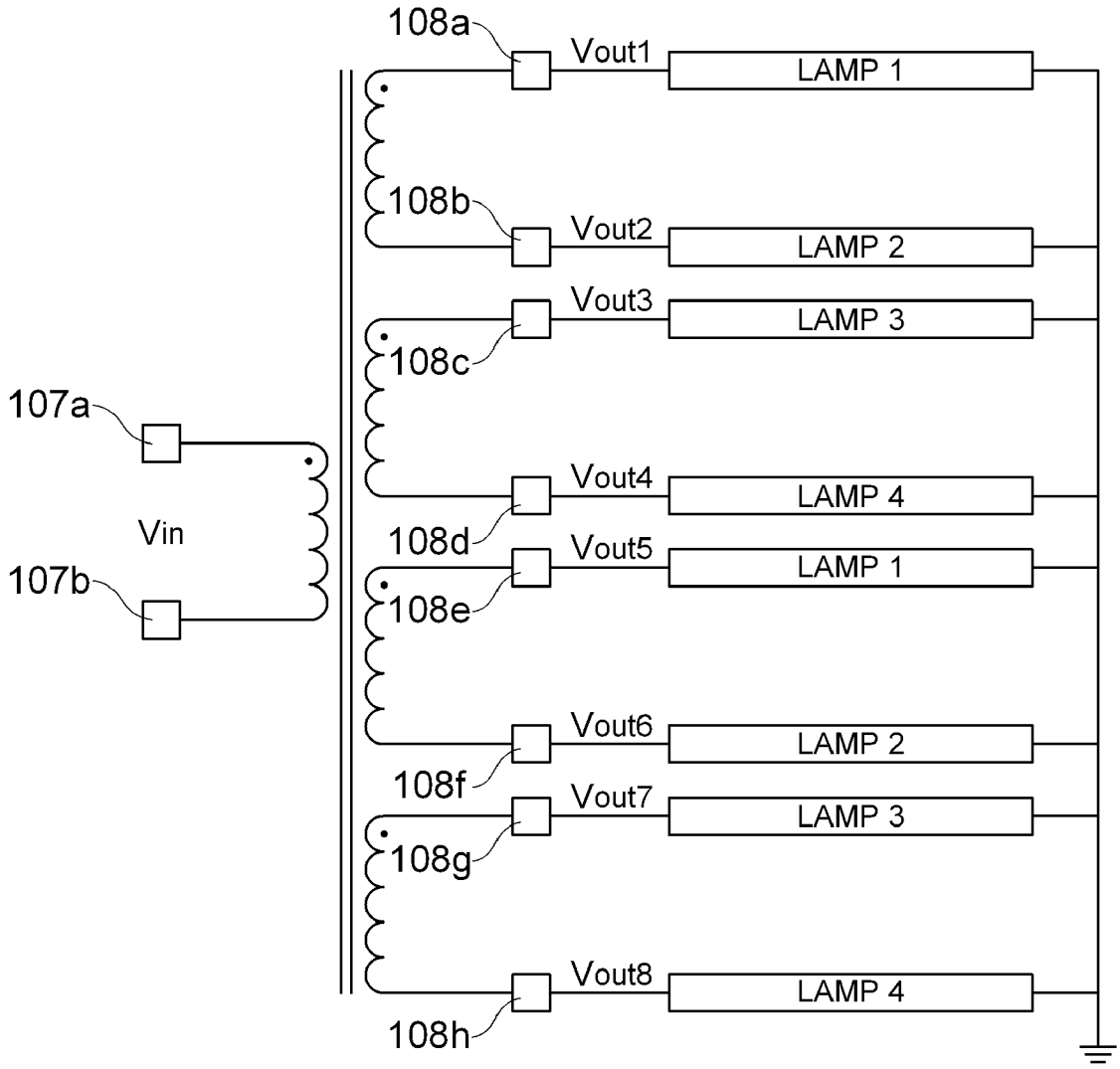

[FIG. 12]
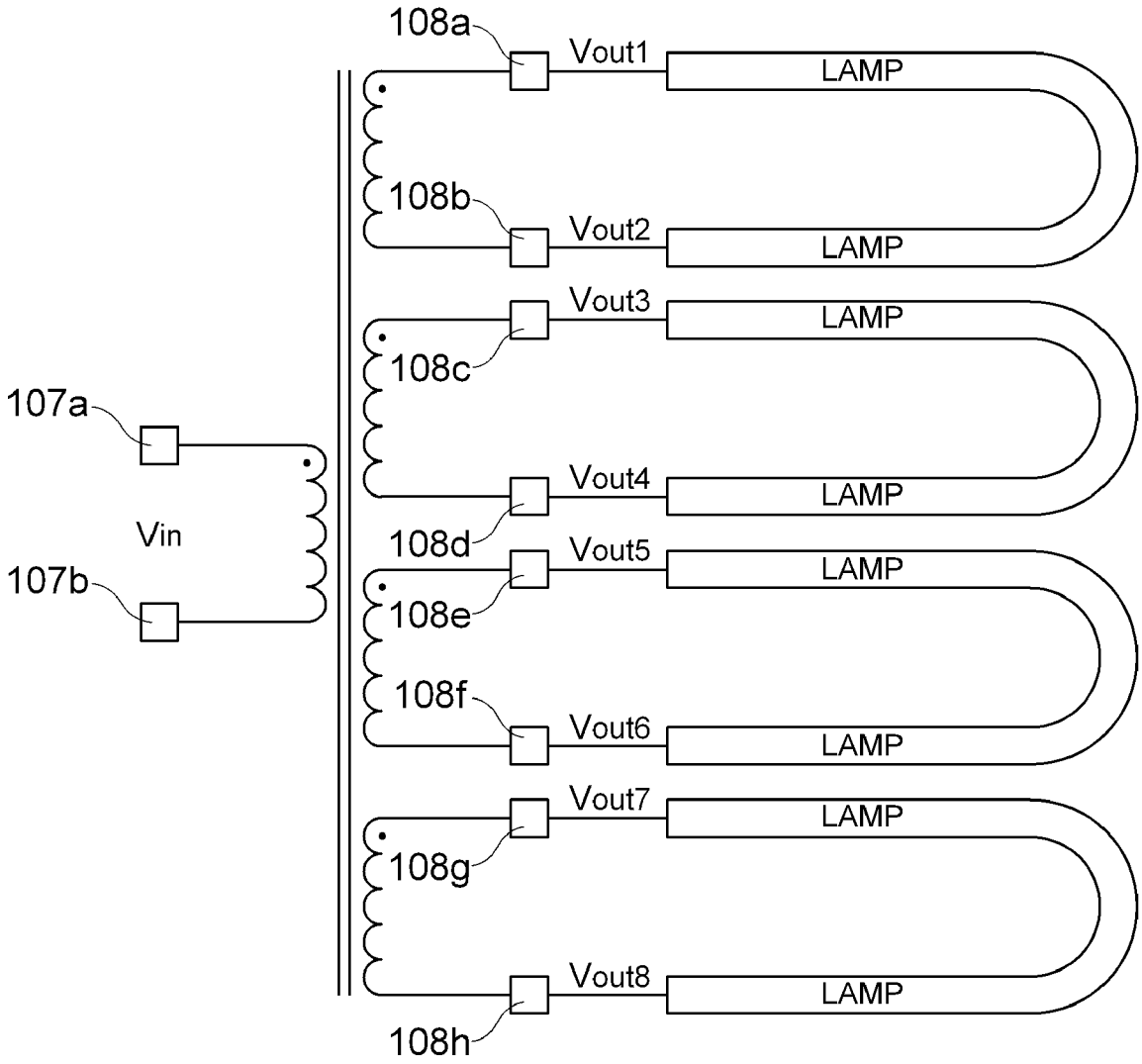

MULTI-OUTPUT TRANSFORMER

CROSS-REFERENCE TO RELATED APPLICATIONS

This application claims the benefit of Korean Patent Application Nos. 10-2008-0029652 and 10-2008-0029656 filed with the Korea Intellectual Property Office on Mar. 31, 2008, the disclosure of which are incorporated herein by references.

BACKGROUND OF THE INVENTION

1. Field of the Invention

The present invention relates to a transformer; and, more particularly, to a multi-output transformer with a primary bobbin forming a primary side and a secondary bobbin forming a secondary side and separated from the primary bobbin and a multi-output transformer with a primary bobbin forming a primary side and inserted into an insertion hole formed inside a secondary bobbin forming a secondary side.

2. Description of the Related Art

Nowadays, with development of display device technique, a monitor as an LCD(Liquid Crystal Display) has been widely used in the field of a computer or other display devices. As compared with a CRT(Cathode-Ray Tube) monitor, an LCD monitor has advantages that a longitudinal section is slimmed and flicker is reduced. The LCD monitor has a fluorescent lamp driven at high voltage for a back light system needing a back light module.

Meanwhile, an inverter with a driving circuit is used for driving the fluorescent lamp and the inverter has a high voltage transformer, wherein the transformer plays a role of supplying voltage to the lamp constituting an LCD panel by generating high AC output voltage with low AC input voltage.

A conventional transformer supplies power to one lamp by driving one transformer, however, in case of driving EEFLs (External Electrode Fluorescent Lamps) or CCFLs(Cold Cathode Fluorescent Lamps) in parallel, the several lamps are supplied with power by driving several transformers.

Meanwhile, as an LCD TV or monitor market gradually has arrived at a maturing stage and a selling price has fallen, prices of back light unit-related components have gradually fallen.

Therefore, due to pressure of the prices of the back light unit-related components, effort to reduce the number of components and the unit cost has been made, and in an effort to this, development of a product capable of driving the several lamps with one transformer has been actively progressed.

SUMMARY OF THE INVENTION

It is one object of the present invention to provide a multi-output transformer capable of effectively generating multi-output from one transformer according to an electric characteristic by separating a primary bobbin forming one primary side and a secondary bobbin forming n(n: positive integer) number of secondary sides.

It is the other object of the present invention to provide a multi-output transformer capable of effectively generating multi-output from one transformer according to an electric characteristic by inserting a primary bobbin forming one primary side into an insertion hole formed inside a secondary bobbin forming n secondary sides.

In accordance with an aspect of the present invention, there is provided a multi-output transformer including a primary bobbin provided with one primary winding unit with one input terminal and one ground terminal; a secondary bobbin provided with n(n: positive integer) number of secondary winding units with two output terminals respectively; a primary coil wound around the one primary winding unit; secondary coils wound around each of the n secondary winding units; and a pair of cores inserted into insertion holes formed inside the primary bobbin and the secondary bobbin respectively to separate the primary bobbin and the secondary bobbin.

In accordance with the present invention, the secondary bobbin may have the same size as the primary bobbin and be positioned to correspond to the primary bobbin.

In accordance with the present invention, all the input terminal and ground terminal of the primary winding unit may be positioned in the same direction.

In accordance with the present invention, all the two output terminals of each of the secondary winding units may be positioned in the same direction.

In accordance with the present invention, the one input terminal and the one ground terminal may be positioned on both ends of the primary winding unit.

In accordance with the present invention, the two output terminals may be positioned on both ends of each of the secondary winding units.

In accordance with the present invention, a winding of the primary coil may begin at the input terminal of the primary winding unit and finish at the ground terminal.

In accordance with the present invention, a winding of the secondary coil may begin at one output terminal of the secondary winding unit and finish at the other output terminal of the secondary winding unit.

In accordance with the present invention, there is provided a multi-output transformer including a primary bobbin provided with one primary winding unit with one input terminal and one ground terminal; a secondary bobbin provided with n(n: positive integer) number of secondary winding units with two output terminals in the same direction respectively; a primary coil wound around the one primary winding unit; secondary coils wound around each of the n secondary winding units; and a pair of cores inserted into insertion holes formed inside the primary bobbin and the secondary bobbin to separate the primary bobbin and the secondary bobbin, wherein the secondary bobbin has n+1(n: positive integer) auxiliary terminals in a direction opposite to the two output terminals and the auxiliary terminals are positioned on both ends of each of the secondary winding units.

In accordance with the present invention, a winding of the secondary coil may begin at the auxiliary terminal of the secondary winding unit and finish at any one of the two output terminals of the secondary winding unit.

In accordance with the present invention, the core may be an "U" shaped-core.

In accordance with still another aspect of the present invention, there is provided a multi-output transformer including a primary bobbin provided with one primary winding unit with one input terminal and one ground terminal; a secondary bobbin provided with n(n: positive integer) number of secondary winding units with two output terminals respectively; a primary coil wound around the one primary winding unit; secondary coils wound around each of the n secondary winding units; and a pair of cores, wherein the primary bobbin is inserted into an insertion hole formed inside the secondary bobbin and the pair of cores are inserted into insertion holes formed inside the primary bobbin.

In accordance with the present invention, the one input terminal and the one ground terminal may be positioned at both ends of the primary winding unit.

In accordance with the present invention, all the two output terminals of each of the secondary winding units may be positioned in the same direction.

In accordance with the present invention, the two output terminals may be positioned on both ends of the second winding unit.

In accordance with the present invention, a winding of the primary coil may begin at the input terminal of the primary winding unit and finish at the ground terminal.

In accordance with the present invention, a winding of the secondary coil may begin at the one terminal of the secondary winding unit and finish at the other terminal thereof.

In accordance with still another aspect of the present invention, there is provided a multi-output transformer including a primary bobbin provided with one primary winding unit with one input terminal and one ground terminal; a secondary bobbin provided with n(n: positive integer) number of secondary winding units with two output terminals in the same direction respectively; a primary coil wound around the one primary winding unit; secondary coils wound around each of the n secondary winding units; and a pair of cores, wherein the primary bobbin is inserted into an insertion hole formed inside the secondary bobbin, the pair of cores are inserted into insertion holes formed inside the primary bobbin, the secondary bobbin has n+1(n: positive integer) auxiliary terminals in a direction opposite to the two output terminals and the auxiliary terminals are positioned on both ends of each of the secondary winding units.

In accordance with the present invention, a winding of the secondary coil may begin at the auxiliary terminal of the secondary winding unit and finish at any one of the two output terminals of the secondary winding unit.

In accordance with the present invention, the cores may be "U" shape.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which:

FIG. 1 is a plan-view showing a multi-output transformer in accordance with a first embodiment of the present invention;

FIG. 2 is a view showing an equivalent circuit of the multi-output transformer in FIG. 1;

FIG. 3 is a view showing an equivalent circuit of the multi-output transformer in FIG. 1;

FIG. 4 is a plan-view showing a multi-output transformer in accordance with a second embodiment of the present invention;

FIG. 5 is a view showing an equivalent circuit of the multi-output transformer in FIG. 4;

FIG. 6 is a view showing an equivalent circuit of the multi-output transformer in FIG. 4.

FIG. 7 is a plan-view showing a multi-output transformer in accordance with a third embodiment of the present invention;

FIG. 8 is a view showing an equivalent circuit of the multi-output transformer in FIG. 7;

FIG. 9 is a view showing an equivalent circuit of the multi-output transformer in FIG. 7;

FIG. 10 is a plan-view showing a multi-output transformer in accordance with a fourth embodiment of the present invention;

FIG. 11 is a view showing an equivalent circuit of the multi-output transformer in FIG. 10; and FIG. 12 is a view showing an equivalent circuit of the multi-output transformer in FIG. 10.

DETAILED DESCRIPTION OF THE PREFERRED EMBODIMENTS

Hereinafter, the present invention will be appreciated clearly through the following detailed description with reference to the accompanying drawings illustrating preferable embodiments of the present invention. However, the present invention may be modified in various types and the scope of the present invention will not be limited to the following embodiments. The embodiments of the present invention are provided to more completely describe the present invention to those skilled in the art. Therefore, the shapes and sizes of components in the drawings may be overdrawn for more clear description and the same component is represented by the same reference numeral.

First Embodiment

FIG. 1 is a plan-view showing a multi-output transformer provided with a primary bobbin and a separated secondary bobbin with two secondary winding units in accordance with a first embodiment of the present invention, and FIG. 2 and FIG. 3 are views showing equivalent circuits of the multi-output transformer.

Referring to FIG. 1, in accordance with a first embodiment of the present invention, a multi-output transformer provided with a primary bobbin 10 and a separated secondary bobbin 11 with two secondary winding units includes the primary bobbin 10 provided with one primary winding unit 13, the secondary bobbin 11 provided with two secondary winding units 14, a primary coil 15 wound around the primary winding unit 13, secondary coils 16 wound around the two secondary winding units 14 respectively, and a pair of cores 12 inserted into insertion holes formed inside the primary bobbin 10 and the secondary bobbin 11.

The one primary winding unit 13 formed on the primary bobbin 10 may include one input terminal 17*a* and one ground terminal 17*b*. Primary side voltage is applied through the input terminal 17*a* and the input terminal 17*a* and the ground terminal 17*b* may be positioned in the same direction. Further, the input terminal 17*a* and the ground terminal 17*b* may be positioned on both ends of the primary winding unit 13.

The primary coil 15 is wound around the primary winding unit 13 of the primary bobbin 10, wherein a winding of the primary coil 15 may begin at the input terminal 17*a* of the primary winding unit 13 and finish at the ground terminal 17*b*.

The two secondary winding units 14 formed on the secondary bobbin 11 separated from the primary bobbin 10 may include two output terminals 18*a*~18*d* respectively. All the two output terminals 18*a*~18*d* of each of the secondary winding units 14 may be positioned in the same direction. Further, the two output terminals 18*a* and 18*b* may be positioned on both ends of the secondary winding unit 14.

The secondary coil 16 is wound around each of the secondary winding unit 14 of the secondary bobbin 11, wherein a winding of the secondary coil 16 may begin at the one output terminal 18*a* of the secondary winding unit 14 and finish at the other output terminal 18*b* thereof.

Referring to FIG. 2 and FIG. 3, through the above construction, even when driving lamps by using conventional four transformers, the one transformer can drive four lamps or two 'U' shaped lamps. Therefore, it is possible to reduce a cost by ¼ in comparison when driving the conventional transformer and the size of a product using the multi-output transformer in comparison with a product using the conventional transformer.

The secondary bobbin 11 is separated from the primary bobbin 10 at a predetermined interval to secure a sufficient insulating separation distance from a printed circuit board electrically connected to the transformer and prevent generation of a return wire of a high voltage output side causing a lot of conventional problems, thereby overcoming an insulating problem between the high voltage side and the return wire and preventing generation of noise due to the return wire as well as waveform distortion of output current.

Further, the secondary bobbin 11 may have the same size as the primary bobbin 10 and be positioned to correspond to the primary bobbin 10. Therefore, the primary coil 15 wound around the primary winding unit 13 corresponds to the secondary coil 16 wound around each of the secondary winding units 14 at the same winding ratio always, whereby the primary side voltage is uniformly induced to the secondary side to balance output current.

Further, the pair of cores 12 are inserted into insertion holes formed inside the primary bobbin 10 and the secondary bobbin 11 to separate the primary bobbin 10 and the secondary bobbin 11 and an 'U'-shaped core may be inserted in the multi-output transformer.

In accordance with the first embodiment of the present invention, the secondary bobbin 11 of the multi-output transformer with the two secondary winding units 14 may include the four output terminals 18*a*~18*d* and three auxiliary terminals 19*a*~19*c* in a direction opposite to the two output terminals and the auxiliary terminals 19*a*~19*c* may be positioned on both ends of each of the second winding units 14.

At this time, a winding of the secondary coil 16 may begin at one auxiliary terminal 19*a* of the secondary winding unit 14 and finish at any one 18*b* of the two output terminals 18*a* and 18*b*. Further, the winding of the secondary coil 16 may begin at another auxiliary terminal 19*b* and finish at any one output terminal 18*a*.

Further, in a back light driving circuit including the multi-output transformer, the auxiliary terminals 19*a*~19*c* can perform a protection function to interrupt power supply when abnormal voltage is sensed by sensing high voltage output voltage induced to each of the secondary winding unit 14.

Through the above construction, in accordance with the first embodiment of the present invention, the one multi-output transformer can drive the two lamps or the one 'U'-shaped lamp, and thus to obtain output desired by a user with the one transformer according to a winding type.

Second Embodiment

FIG. 4 is a plan-view showing a multi-output transformer provided with a primary bobbin and a separated secondary bobbin with four secondary winding units in accordance with a second embodiment of the present invention, and FIG. 5 and FIG. 6 are views showing equivalent circuits of the multi-output transformer.

Referring to FIG. 4, in accordance with a second embodiment of the present invention, a multi-output transformer provided with a primary bobbin 40 and a separated secondary bobbin 41 with four secondary winding units includes the primary bobbin 40 provided with one primary winding unit 43, the secondary bobbin 41 provided with four secondary winding units 44, a primary coil 45 wound around the one primary winding unit 43, secondary coils 46 wound around the four secondary winding units 44 respectively, and a pair of cores 42 inserted into insertion holes formed inside the primary bobbin and the secondary bobbin.

The one primary winding unit 43 formed on the primary bobbin 40 may include one input terminal 47*a* and one ground terminal 47*b*. Primary side voltage is applied through the input terminal 47*a* and the input terminal 47*a* and the ground terminal 47*b* may be positioned in the same direction. Further, the input terminal 47*a* and the ground terminal 47*b* may be positioned on both ends of the primary winding unit 43.

The primary coil 45 is wound around the primary winding unit 43 of the primary bobbin 40, wherein a winding of the primary coil 45 may begin at the input terminal 47*a* of the primary winding unit 43 and finish at the ground terminal 47*b*.

The four secondary winding units 44 formed on the secondary bobbin 41 separated from the primary bobbin 40 may include two output terminals 48*a*~48*h* respectively. All the two output terminals 48*a*~48*h* of each of the secondary winding units 44 may be positioned in the same direction. Further, the two output terminals 48*a* and 48*b* may be positioned on both ends of the secondary winding unit 44.

The secondary coil 46 is wound around each of the secondary winding units 44 of the secondary bobbin 41, wherein a winding of the secondary coil 46 may begin at the one output terminal 48*a* of the secondary winding unit 44 and finish at the other output terminal 48*b* thereof.

Referring to FIG. 5 and FIG. 6, through the above construction, even when driving lamps by using conventional eight transformers, the one transformer can drive eight lamps or four 'U' shaped lamps. Therefore, it is possible to reduce a cost by ⅛ in comparison when driving the conventional transformer and the size of a product using the multi-output transformer in comparison with a product using the conventional transformer.

The secondary bobbin 41 is separated from the primary bobbin 40 at a predetermined interval to secure a sufficient insulating separation distance from a printed circuit board electrically connected to the transformer and prevent generation of a return wire of a high voltage output side causing a lot of conventional problems, thereby overcoming an insulating problem between the high voltage side and the return wire and preventing generation of noise due to the return wire as well as waveform distortion of output current.

Further, the secondary bobbin 41 may have the same size as the primary bobbin 40 and be positioned to correspond to the primary bobbin 40. Therefore, the primary coil 45 wound around the primary winding unit 43 corresponds to the secondary coil 46 wound around each of the secondary winding units 44 at the same winding ratio always, whereby the primary side voltage is uniformly induced to the secondary side to balance output current.

Further, the pair of cores 42 are inserted into insertion holes formed inside the primary bobbin 40 and the secondary bobbin 41 to separate the primary bobbin 40 and the secondary bobbin 41 and an 'U'-shaped core may be inserted in the multi-output transformer.

In accordance with the second embodiment of the present invention, the secondary bobbin 41 of the multi-output transformer with the four secondary winding units 44 may include eight output terminals 48*a*~48*h* and five auxiliary terminals 49*a*~49*e* in a direction opposite to the two output terminals and the auxiliary terminals 49*a*~49*e* may be positioned on both ends of each of the second winding units 44.

At this time, a winding of the secondary coil 46 may begin at one auxiliary terminal 49*a* of the secondary winding unit 44 and finish at any one 48*b* of two output terminals 48*a*~48*b*.

Further, the winding of the secondary coil 46 may begin at another auxiliary terminal 49*b* and finish at any one output terminal 48*a*.

Further, in a back light driving circuit including the multi-output transformer, the auxiliary terminals 49*a*~49*e* can perform a protection function to interrupt power supply when abnormal voltage is sensed by sensing high voltage output voltage induced to each of the secondary winding unit 44.

Through the above construction, in accordance with the second embodiment of the present invention, the one multi-output transformer can drive the four lamps or the two 'U'-shaped lamp, and thus to obtain output desired by a user with the one transformer according to a winding type.

Third Embodiment

FIG. 7 is a plan-view showing a multi-output transformer provided with a primary bobbin inserted into an insertion hole inside a secondary bobbin with two secondary winding units in accordance with a third embodiment of the present invention and FIG. 8 and FIG. 9 are views showing equivalent circuits of the multi-output transformer.

Referring to FIG. 7, in accordance with a third embodiment of the present invention, a multi-output transformer provided with a primary bobbin 70 inserted into an insertion hole inside a secondary bobbin 71 with two secondary winding units includes the primary bobbin 70 provided with one primary winding unit 73, the secondary bobbin 71 provided with two secondary winding units 74, a primary coil 75 wound around the one primary winding unit 73, secondary coils 76 wound around the two secondary winding units 74 respectively, and a pair of cores 72.

The one primary winding unit 73 formed on the primary bobbin 70 may include one input terminal 77*a* and one ground terminal 77*b*. Primary side voltage is applied through the input terminal 77*a* and the input terminal 77*a* and the ground terminal 77*b* may be positioned on both ends of the primary winding unit 73.

The primary coil 75 is wound around the primary winding unit 73 of the primary bobbin 70, wherein a winding of the primary coil 75 may begin at the input terminal 77*a* of the primary winding unit 73 and finish at the ground terminal 77*b*.

The two secondary winding units 74 formed on the secondary bobbin 71 may include two output terminals 78*a*~78*d* respectively. All the two output terminals 78*a*~78*d* of each of the secondary winding units 74 may be positioned in the same direction. Further, the two output terminals 78*a* and 78*b* may be positioned on both ends of the secondary winding unit 74.

The secondary coil 76 is wound around each of the secondary winding units 74 of the secondary bobbin 71, wherein a winding of the secondary coil 76 may begin at the one output terminal 78*a* of the secondary winding unit 74 and finish at the other output terminal 78*b* thereof.

Referring to FIG. 8 and FIG. 9, through the above construction, even when driving lamps by using conventional four transformers, the one transformer can drive four lamps or two 'U'-shaped lamps. Therefore, it is possible to reduce a cost by ¼ in comparison when driving the conventional transformer and a size of a product using the multi-output transformer in comparison with a product using the conventional transformer.

The primary bobbin 70 is inserted into the insertion hole formed inside the secondary bobbin 71 to be spaced at a predetermined interval to secure a sufficient insulating separation distance from a printed circuit board electrically connected to the transformer and prevent generation of a return wire of a high voltage output side causing a lot of conventional problems, thereby overcoming an insulating problem between the high voltage side and the return wire and preventing generation of noise due to the return wire as well as waveform distortion of output current.

Further, the primary bobbin 70 with the same length as the secondary bobbin 71 is inserted into the insertion hole formed inside the secondary bobbin 71 to be spaced at a predetermined interval and thus the primary coil 75 wound around the primary winding unit 73 corresponds to the secondary coil 76 wound around each of the secondary winding units 74 at the same winding ratio always, whereby the primary side voltage is uniformly induced to the secondary side to balance output current.

Further, the primary bobbin 70 is inserted into the insertion hole formed inside the secondary bobbin 71, the pair of cores 72 are inserted into insertion holes formed inside the primary bobbin 70 and an "U'-shaped core may be inserted in the multi-output transformer.

In accordance with the third embodiment of the present invention, the secondary bobbin 71 of the multi-output transformer with the two secondary winding units 74 may include four output terminals 78*a*~78*d* and three auxiliary terminals 79*a*~79*c* in a direction opposite to the two output terminals and the auxiliary terminals 79*a*~79*c* may be positioned on both ends of each of the second winding units 74.

At this time, a winding of the secondary coil 76 may begin at one auxiliary terminal 79*a* of the secondary winding unit 74 and finish at any one 78*b* of two output terminals 78*a*~78*b*. Further, the winding of the secondary coil 76 may begin at another auxiliary terminal 79*b* and finish at any one output terminal 78*a*.

Further, in a back light driving circuit including the multi-output transformer, the auxiliary terminals 79*a*~79*c* can perform a protection function to interrupt power supply when abnormal voltage is sensed by sensing high voltage output voltage induced to each of the secondary winding unit 74.

Through the above construction, in accordance with the third embodiment of the present invention, the one multi-output transformer can drive the two lamps or the one 'U'-shaped lamp, and thus to obtain output desired by a user with the one transformer according to a winding type.

Fourth Embodiment

FIG. 10 is a plan-view showing a multi-output transformer provided with a primary bobbin inserted into an insertion hole inside a secondary bobbin with four secondary winding units in accordance with a fourth embodiment of the present invention, and FIG. 11 and FIG. 12 are views showing equivalent circuits of the multi-output transformer.

Referring to FIG. 10, in accordance with a fourth embodiment of the present invention, a multi-output transformer provided with a primary bobbin 100 inserted into an insertion hole inside a secondary bobbin 101 with four secondary winding units includes the primary bobbin 100 provided with one primary winding unit 103; the secondary bobbin 101 having four secondary winding units 104, a primary coil 105 wound around the primary winding unit 103, secondary coils 106 wound around the four secondary winding units 104 respectively, and a pair of cores 102.

The one primary winding unit 103 formed on the primary bobbin 100 may include one input terminal 107*a* and one ground terminal 107*b*. Primary side voltage is applied through the input terminal 107*a* and the input terminal 107*a* and the ground terminal 107*b* may be positioned on both ends of the primary winding unit 103.

The primary coil 105 is wound around the primary winding unit 103 of the primary bobbin 100, wherein a winding of the primary coil 105 may begin at the input terminal 107*a* of the primary winding unit 103 and finish at the ground terminal 107*b*.

The four secondary winding units 104 formed on the secondary bobbin 101 may include two output terminals 108*a*~108*h* respectively. The two output terminals 108*a*~108*h* of each of the secondary winding units 104 may be positioned in the same direction. Further, the two output terminals 108*a* and 108*b* may be positioned on both ends of the secondary winding unit 104.

The secondary coil 106 is wound around each of the secondary winding units 104 of the secondary bobbin 101, wherein a winding of the secondary coil 106 may begin at the one output terminal 108*a* of the secondary winding unit 104 and finish at the other output terminal 108*b* thereof.

Referring to FIG. 11 and FIG. 12, through the above construction, even when driving lamps by using conventional eight transformers, the one transformer can drive eight lamps or four 'U'-shaped lamps. Therefore, it is possible to reduce a cost by ⅛ in comparison when driving the conventional transformer and a size of a product using the multi-output transformer in comparison with a product using the conventional transformer.

The primary bobbin 100 is inserted into an insertion hole formed inside the secondary bobbin 101 to be spaced at a predetermined interval to secure a sufficient insulating separation distance from a printed circuit board electrically connected to the transformer and prevent generation of a return wire of a high voltage output side causing a lot of conventional problems, thereby overcoming an insulating problem between the high voltage side and the return wire and preventing generation of noise due to the return wire as well as waveform distortion of output current.

Further, the primary bobbin 100 with the same length as the secondary bobbin 101 is inserted into the insertion hole formed inside the secondary bobbin 101 to be spaced at a predetermined interval and thus the primary coil 105 wound around the primary winding unit 103 corresponds to the secondary coil 106 wound around each of the secondary winding units 104 at the same winding ratio always, whereby the primary side voltage is uniformly induced to the secondary side to balance output current.

Further, the primary bobbin 100 is inserted into the insertion hole formed inside the secondary bobbin 101, the pair of cores 102 are inserted into insertion holes formed inside the primary bobbin 100 and an "U'-shaped core may be inserted in the multi-output transformer.

In accordance with the fourth embodiment of the present invention, the secondary bobbin 101 of the multi-output transformer with the four secondary winding units 104 may include eight output terminals 108*a*~108*h* and five auxiliary terminals 109*a*~109*e* in a direction opposite to the two output terminals and the auxiliary terminals 109*a*~109*e* may be positioned on both ends of each of the second winding units 104.

At this time, a winding of the secondary coil 106 may begin at one auxiliary terminal 109*a* of the secondary winding unit 104 and finish at any one 108*b* of two output terminals 108*a* and 108*b*. Further, the winding of the secondary coil 106 may begin at another auxiliary terminal 109*b* and finish at any one output terminal 108*a*.

Further, in a back light driving circuit including the multi-output transformer, the auxiliary terminals 109*a*~109*e* can perform a protection function to interrupt power supply when abnormal voltage is sensed by sensing high voltage output voltage induced to each of the secondary winding unit 104.

Through the above construction, in accordance with the fourth embodiment of the present invention, the one multi-output transformer can drive the four lamps or the two 'U'-shaped lamp, and thus to obtain output desired by a user with the one transformer according to a winding type.

As described above, in accordance with the preferable embodiments of the present invention, the multi-output transformer is capable of solving the balance problem of the output current and the insulating problem of the high voltage output by separating the primary bobbin forming one primary side from the secondary bobbin forming n(n: positive integer) number of secondary sides or inserting the primary bobbin forming the one primary side into the insertion hole formed inside the secondary bobbin forming the n(n: positive integer) number of secondary sides and reducing the need of the transformer by effectively generating multi-output with the one transformer according to an electric characteristic.

As described above, although a few preferable embodiments of the present invention have been shown and described, it will be appreciated by those skilled in the art that substitutions, modifications and changes may be made in these embodiments without departing from the principles and spirit of the general inventive concept, the scope of which is defined in the appended claims and their equivalents.

What is claimed is:

1. A multi-output transformer comprising:

a primary bobbin including one primary winding unit with one input terminal and one ground terminal;

a secondary bobbin including n(n: positive integer) number of secondary winding units each with two output terminals in the same direction;

a primary coil wound around the one primary winding unit;

a secondary coil wound around each of the n secondary winding units; and a pair of cores inserted into insertion holes formed inside the primary bobbin and the secondary bobbin, respectively, to separate the primary bobbin and the secondary bobbin, wherein the secondary bobbin includes n+1(n: positive integer) auxiliary terminals in a direction opposite to the two output terminals and the auxiliary terminals are positioned on opposite ends of each of the secondary winding units, wherein a winding of the secondary coil begins at an auxiliary terminal of the secondary winding unit and finishes at any one of two output terminals of the secondary winding unit.

* * * * *